United States Patent [19]

Moore

[11] B 3,987,457

[45] Oct. 19, 1976

[54] VARIABLE PROPERTY WIRE MESH ANTENNA STRUCTURE

[75] Inventor: David W. Moore, Manhattan Beach, Calif.

[73] Assignee: TRW Inc., Redondo Beach, Calif.

[22] Filed: Aug. 5, 1974

[21] Appl. No.: 494,691

[44] Published under the second Trial Voluntary Protest Program on March 16, 1976 as document No. B 494,691.

[52] U.S. Cl. ..... 343/840; 343/897; 343/915

[51] Int. Cl.[2] ..... H01Q 15/20

[58] Field of Search ..... 343/840, 897, 912, 915

*Primary Examiner*—Eli Lieberman
*Attorney, Agent, or Firm*—Daniel T. Anderson; Donald R. Nyhagen; Jerry A. Dinardo

[57] ABSTRACT

A resiliently compliant, variable stiffness wire mesh structure, primarily for space applications, characterized by its lightweight construction, its compact stowage and deployment capability, and its ability to maintain its nominal shape under widely varying thermal conditions. The structure has a frame supporting a wire mesh including spring-like longitudinally compliant wires which are terminally secured to the frame to constitute primary structural elements of the mesh and are prestressed in a manner such that the compliant spring wires in different sections of the mesh have differing spring rates or stiffness. This non-uniform stiffness of the mesh is designed to maintain the mesh taut under widely varying thermal conditions and thereby avoid the formation of slack in the mesh wires which would allow out-of-plane displacement of the mesh. The described mesh structure is a wire mesh antenna reflector for space applications.

3 Claims, 7 Drawing Figures

VARIABLE PROPERTY WIRE MESH ANTENNA STRUCTURE

The invention described herein was made in the course of or under a contract or subcontract thereunder, (or grant), with the Department of the Air Force.

RELATED APPLICATIONS

The present U.S. Patent application is related to copending applications of Elmer Smith and Samuel Weinstein entitled "Welding Method and Machine for Fabricating a Wire," filed May 24, 1974, Ser. No. 473,109, and John Archer, entitled "Compliant Mesh Structure and Method of Making Same," filed July 1, 1974, Ser. No. 484,635.

BACKGROUND OF THE INVENTION

1. Field of the Invention

This invention relates generally to lightweight structures for spacecraft and other applications and more particularly to a novel wire mesh structure of this kind and to its method of fabrication.

2. Prior Art

As will appear from the later description, the wire mesh structure of the invention may assume a variety of forms depending upon its intended use. The particular structure described is an antenna reflector, specifically a parabolic reflector, for spacecraft.

A high premium is placed on the weight of spacecraft components, such as antennas, which must be traded off against all aspects of the total system performance to obtain an optimum design. This is particularly true in systems requiring parabolic surfaces as antenna reflectors. The technical requirements of minimum distortions for high performance, a need for stowage during the boost phase, combined with exposure to the extremes of the orbital environment after deployment, place severe constraints on the design.

A variety of spacecraft antennas have been devised in an attempt to satisfy the above and other design constraints. These existing antennas, however, fail to fully satisfy all the constraints. For example, antennas having rigid reflector surfaces, such as utilized in the sunflower concept. have the disadvantage of relatively high weight ratios and stowage space difficulty; coated fabric surfaces have the disadvantage of poor electrical characteristics and deterioration in the space radiation environment; and metallic fabric surfaces, in general, have the disadvantage of extreme sensitivity to dimensional tolerances, and are subject to large temperature excursions which cause large thermal distortions and thus result in significant areas of slack mesh between supports.

The earlier mentioned copending applications describe a wire mesh antenna reflector and its method of fabriction which avoid the above noted and other disadvantages of the existing reflectors and satisfy the stated spacecraft antenna design constraints. Simply stated, the antenna reflector is characterized by a wire mesh reflecting surface having wires which constitute primary structural elements of the mesh and are attached at their ends to the reflector frame. These structural elements or wires are preformed to a low rate spring-like configuration which renders the wires resiliently compliant in the endwise direction and are prestressed in a manner such that the wire mesh remains taut under widely varying thermal conditions, thus avoiding out-of-plane displacement of the mesh.

The particular antenna reflector described is a parabolic reflector having a supporting frame with a central reflector dish and ribs extending radially from the dish, flush with the front face thereof. These ribs and the front face of the reflector dish conform to a common parabolic surface. The spaces between adjacent ribs are spanned by wire mesh gores having wires, referred to herein as hoop wires, extending generally circumferentially or hoopwise of the reflector and other wires, referred to as radial wires, extending generally radially of the reflector. The hoop wires are terminally secured to the ribs and constitute the compliant structural wires of the mesh. The radial wires stabilize the mesh and cooperate with the hoop wires to provide the required electrical characteristics of the reflector.

According to the reflector gore fabricating method described in the copending applications, the gore hoop wires are first formed to their spring configuration and are then prestressed to a tension, referred to as a preload tension or simply a preload, greater than the maximum tension load exerted on the hoop wires in actual use of the antenna reflector in the space environment. This preload insures that the tension loads exerted on the hoop wires in use will not produce permanent deformation of these wires, which would alter their spring rate or stiffness, and permits the effective spring rate or stiffness of the reflector mesh to be accurately predetermined and maintained over the full service life of the antenna reflector. After preloading, the hoop wires are welded to radial wires to form wire mesh gores which are assembled on the antenna reflector frame to form a finished wire mesh antenna reflector surrounding the central reflector dish. The steps of welding of the hoop and radial wires to form wire mesh reflector gores and assemblying these gores on the reflector frame to form a finished wire mesh antenna reflector are performed in a manner which establishes in the hoop wires of the finished reflector a predetermined tension, referred to as an initial or assembly tension. This assembly tension is made sufficiently high to insure that the fluctuations in hoop wire tension occasioned by the changing thermal conditions to which the reflector is exposed in the space environment will not produce complete relaxation of the hoop wire tension, such that the reflector mesh would become slack. The reflector mesh thus remains taut, to retain the parabolic configuration of the reflector, over the entire range of thermal conditions encountered by the reflector in use.

The wire mesh structure of the copending applications is characterized by compliant spring wires of uniform spring rate or stiffness throughout the entire area of the wire mesh. Such a uniform spring rate is quite satisfactory for many wire mesh structures as, for example, those whose conditions of use are such that all of the mesh spring wires are subjected to substantially the same tension loads or stress fluctuations. On the other hand, the conditions of use of some wire mesh structures are such that the tautness of the wire mesh could not be maintained if all of the mesh spring wires had the same spring rate or stiffness. Examples of these latter use conditions are those which subject the spring wires in different areas of the wire mesh to substantially different thermally induced tension loads or stress fluctuations and those which subject some spring wires primarily to thermally induced tension loads and other spring wires to inertial loads.

SUMMARY OF THE INVENTION

This invention provides a resiliently compliant wire mesh structure of the character described which is characterized by non-uniform spring rate or stiffness, that is by a spring rate or stiffness in the endwise direction of its spring wires which varies from one area or section of the wire mesh to another. This variation in spring rate or stiffness is accomplished by varying any one or more of the spring wire parameters: wire metal, wire diameter, wire spacing, spring configuration or pitch, preload tension, i.e., the tension load applied to the spring wires prior to welding of these wires to transverse wires to form a wire mesh, and assembly tension, i.e., the tension established in the spring wires during assembly of the wire mesh on its supporting frame.

The particular wire mesh structure described is a parabolic wire mesh antenna reflector for a communication satellite, which reflector is similar to that described in the copending applications except that the reflector ribs are hinged to the central reflector dish for deployment of the ribs and wire mesh from a contracted stowage configuration to their parabolic configuration of use. In the contracted stowage configuration, the reflector ribs extend forwardly of the reflector dish and curve inwardly toward the reflector axis with the wire mesh gores of the reflector folded and gathered between the ribs. The ribs are spring loaded to swing outwardly and rearwardly by spring action during deployment. Stops are provided at the inner ends of the ribs to arrest the latter when fully deployed.

The radially outer and radially inner compliant hoop wires of this deployable wire mesh reflector are subjected to different critical load conditions. Thus, during deployment, the reflector ribs swing outwardly and rearwardly by spring action until abruptly arrested in their fully deployed positions. This abrupt arresting of the ribs causes their outer end portions to deflect rearwardly beyond the deployed positions because of their momentum and that of the wire mesh. This rearwardly deflection or overtravel of the outer rib ends imposes a substantial tension load on the radially outer hoop wires. The inner end portions of the ribs, on the other hand, are relatively stiff and thus experience very little overtravel during deployment, with the result that the radially inner hoop wires are not subjected to the same relatively high deployment loads as the outer hoop wires.

On the other hand, during use of the deployed reflector on an orbiting satellite, the central reflector dish and the adjacent hoop wires of the reflector mesh, that is, the radially inner hoop wires, undergo substantial differential thermal expansion and contraction owing in part to the fact that the dish and mesh are constructed of different metals, in part to the large temperature fluctuations during each orbit, and in part to non-uniform exposure of the reflector to solar radiation, i.e., exposure of the dish while the mesh is shaded or exposure of the mesh while the dish is shaded.

As explained in more detail later, the above conditions create the need for reflector gores having radially inner and outer sections having hoop wires of differing spring rates or stiffness. The described wire mesh reflector embodies such dual spring rate gores. More specifically, the wire mesh gores of the described reflector have radially inner sections whose hoop wires have a relatively low spring rate and low preload to accommodate the relative thermal expansion and contraction of the wire mesh and central reflector dish occasioned by the large orbital temperature fluctuations and non-uniform solar radiation exposure of the dish and mesh without developing slack in the mesh or exceeding the hoop wire preload. The reflector gores have radially outer sections whose hoop wires have a relatively high spring rate and high preload to accommodate the overtravel of the outer ends of the reflector ribs which occurs at the conclusion of reflector deployment without exceeding the hoop wire preload.

While the invention is described in connection with a wire mesh for a deployable spacecraft antenna reflector, the invention may be embodied in wire mesh structures for other purposes. Other applications of wire mesh according to the invention, for example, are antenna feed structures, electrical ground planes, and supporting structures for thin film solar arrays.

DESCRIPTION OF THE PREFERRED EMBODIMENTS

Figure 1:
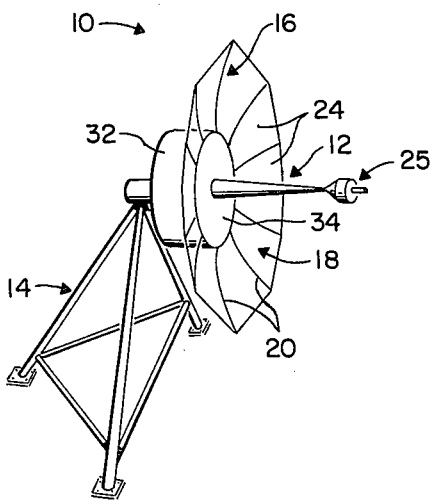
FIG. 1 is a perspective view of a parabolic antenna embodying a wire mesh structure, i.e., a deployable wire mesh antenna reflector, according to the invention.

FIG. 1 illustrates an antenna 10 embodying an antenna reflector 12 according to the invention and a reflector support or mount 14. Reflector 12 has a supporting structure or frame 16 and a wire mesh reflecting surface 18 secured to the frame. The frame 16 includes spaced supporting members 20 and the reflecting surface 18 comprises a number of wire mesh panels 24 positioned between and attached to the frame members. The antenna feed is shown at 25.

Figure 2:
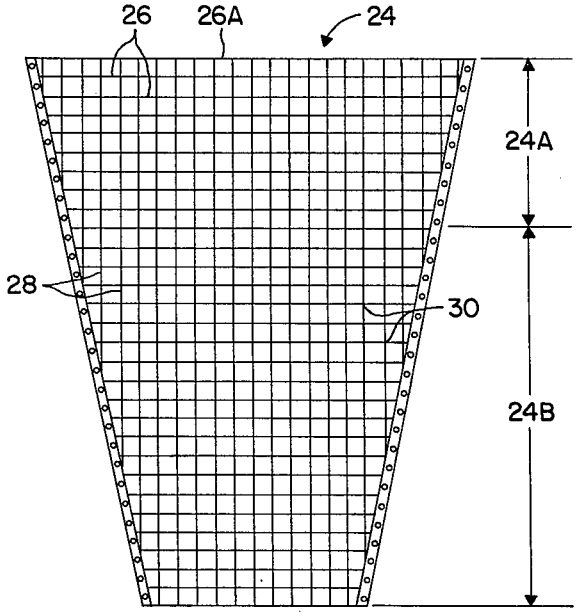
FIG. 2 is an enlarged flat layout of one wire mesh gore of the reflector.
Figure 3:
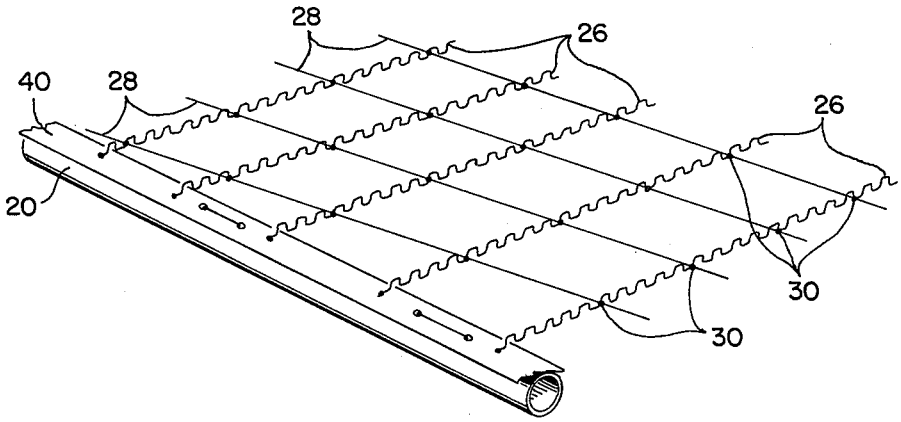
FIG. 3 is a further enlarged fragmentary perspective view of the wire mesh gore.
Figure 4:
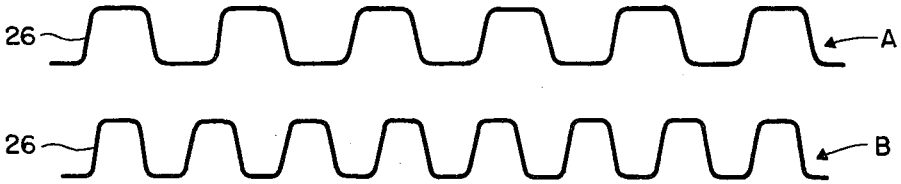
FIG. 4 is a further enlarged view of certain wires of the mesh.

Referring to FIGS. 2 through 4, each wire mesh reflector panel 24 is generally similar to those described in the earlier mentioned copending applications and has parallel wires 26 crossing other parallel wires 28, in this instance in orthogonal relation, and means physically and electrically joining the crossing wires at their crossing points 30. The wires may be spot welded to one another at their crossing points.

Mesh wires 26 constitute the primary structural elements or wires of the mesh panels 24 and are secured at their ends to the adjacent frame members 20. The remaining wires 28 serve to stabilize the mesh and cooperate with the wires 26 to provide the reflector with the required electrical characteristics.

The structural wires 26 of each mesh panel 24 are preformed to a low rate spring-like configuration to render these wires resiliently compliant in their endwise direction. As mentioned earlier and explained in more detail later, the spring wires 26, after formation to their spring configuration, are preloaded to a tension exceeding the maximum tension load imposed on these wires in use and, during installation of the mesh panels on the frame 16, are stressed to a predetermined tension such that the panels remain taut over a wide range of thermal conditions, such as those encountered by an orbiting earth satellite, thereby preventing the creation of slack in the mesh which would permit out-of-plane displacement of the mesh. Such displacement, of course, would degrade the antenna performance.

FIG. 4 illustrates the preferred preformed spring configuration of the wires 26. Other configurations could be utilized, of course. The illustrated configuration is a generally corrugated or serpentine configuration which may be produced in the manner explained later. Suffice it to say here that the preformed wire configuration of FIG. 4 obviously renders the wires 26 resiliently compliant in their endwise direction.

Figure 1A:
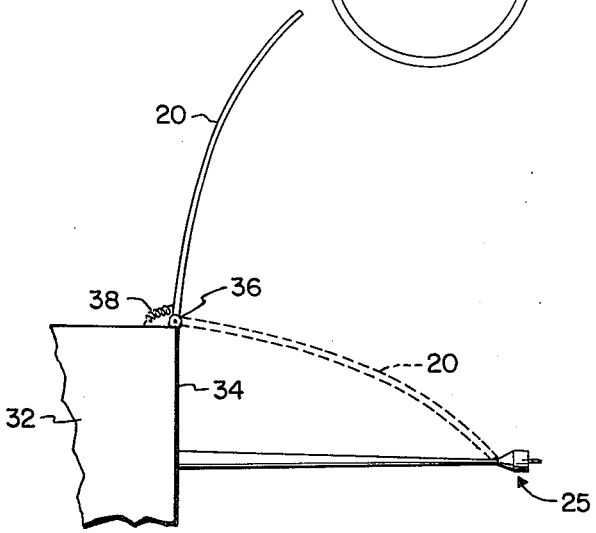
FIG. 1A is an enlarged fragmentary view of the reflector illustrating its method of deployment.

The particular antenna reflector shown is a deployable parabolic reflector. The reflector frame 16 has a central cylindrical hub-like housing 32 with a front reflector dish 34. The mesh supporting members 20 of the frame are slender ribs which are pivotally attached at their inner ends by hinges 36 to the edge of the dish 34, generally flush with its front face, to swing outwardly and rearwardly from their broken line contracted stowage positions of FIG. 1A to their solid line deployed positions of FIGS. 1 and 1A under the action of rib deployment springs 38. Stops (not shown) at the inner ends of the ribs arrest the latter when fully deployed. The front face of the dish 34 and the ribs 20 are parabolically contoured and curved to conform to a common parabolic surface curvature when the ribs are fully deployed to their positions of FIG. 1. The wire mesh panels 24 are mesh gores which are positioned between and secured to the ribs 20 so as to form with the dish 34 a parabolic reflecting surface when in the deployed configuration of FIG. 1. When the ribs are contracted to their stowage configuration, the mesh gores are folded into the space surrounded by the ribs.

The mesh wires 26 and 28 of each gore 24 extend generally hoopwise, that is circumferentially, and generally radially of the deployed reflector and, for this reason, are referred to herein as hoop and radial wires, respectively. The hoop wires 26 are the compliant primary structural spring wires which are terminally secured to the ribs 20 and preloaded tensioned as explained earlier to maintain the mesh panels. The radial wires 28 stabilize the mesh panels and coact with the hoop wires 26 to provide the desired electrical characteristics of the reflector. According to the preferred practice of the invention, the hoop wires 26 are not directly attached to the reflector frame ribs 20 but rather are spot welded or otherwise joined to metallic edge strips 40 which extend along the radial edges of the gores 24 and, in turn, are secured to the ribs.

The radially outermost hoop wires **26*a*** of the gores may be heavier wires or cables which extend between the outer tips of the ribs to stabilize the ribs circumferentially. If desired, additional rib stabilizing hoop cables may be placed at other radial positions along the gores. These cables may be fabricated of a material which has optimum thermal characteristics and may be readily temperature controlled with thermal coatings.

As noted earlier, the hoop wires 26 are preformed to their illustrated spring-like configuration and tensioned to maintain the wire mesh gores 24 taut over a wide range of thermal conditions, such as those encountered by an orbiting earth satellite. Thus, in such an environment, reflector 12 is subjected to widely varying thermal conditions, i.e., sun in front, sun behind, sun at various angles relative to the bore sight, and no sun, eclipse conditions. These varying thermal conditions subject the reflector to a temperature range on the order of +300° to −300°F and to non-uniform exposure to and hence heating by solar radiation, i.e., shading of the mesh gores 24 while the reflector dish 34 is unshaded or shading of the reflector dish while the gores are unshaded, thereby producing relative thermal expansion and contraction of the reflector ribs, mesh, and dish which tend to stretch and relax the mesh. If the hoop wires 26 of the wire mesh gores 24 were simple straight wires, the wire mesh of the gores would become slack, at least at times, thus permitting out-of-plane displacement of the mesh with resultant degradation of the antenna performance.

According to the invention of the copending application Ser. No. 484,635, development of slack in the reflector mesh and resultant degradation of antenna performance is avoided by forming the hoop wires 26 to their resiliently compliant spring configuration, preloading the wires after forming to a tension exceeding the maximum tension load the hoop wires are expected to encounter in use of the reflector, and establishing in the wires of the finished reflector an initial or assembly tension of a predetermined magnitude such that the tension fluctuations which occur in the hoop wires in use never result in sufficient relaxation of the hoop wire tension to produce slack in the mesh, all as explained in the copending application. All of the hoop wires are stressed to the same preload tension and have the same initial or assembly tension in the completed reflector, whereby the wire mesh of the reflector has the same spring rate or stiffness over its entire area.

As noted earlier, this uniformity of spring stiffness is suitable for many antenna applications. Such uniformity of stiffness, however, is not suitable for a deployable antenna reflector of the kind illustrated in the drawings. Thus, as described earlier, the antenna reflector ribs 20 are hinged to the central reflector dish 34 to swing outwardly and rearwardly from their broken line contracted stowage positions of FIG. 1A to their solid line deployed positions of FIGS. 1 and 1A. The rib stops (not shown) engage upon arrival of the ribs at their fully deployed positions to arrest the ribs. Engagement of these stops arrests the radially inner end portions of the ribs with only slight overtravel, i.e., rearward deflection beyond the fully deployed position, because of the proximity of the rib hinges 36 and the resultant stiffness of the rib inner end portions. In contrast, because of the long slender configurations of the ribs, the outer end portions of the ribs experience substantial overtravel when the rib stops engage. The outer hoop cables **26*a* tend to resist this overtravel. However, the outer rib ends still undergo substantial overtravel which, and the rearward momentum of the mesh itself, imposes on the outer hoop wires 26** a tension load exceeding substantially the tension load on the outer hoop wires when the outer rib ends are in proper deployed position.

From the foregoing description, it is evident that the radially inner and outer areas or sections 24A, 24B of the wire mesh of each reflector gore 24 must be designed to withstand different critical conditions. Thus, the radially inner mesh section 24A must be designed to sustain the tension fluctuations in the inner hoop wires occasioned by relative thermal expansion and contraction of the wire mesh of the gores 24 and the central reflector dish 34 resulting from the varying thermal conditions, mentioned earlier, to which the reflector is exposed in the space environment without creation of slack in the mesh or exceeding the preload tension of the inner hoop wires. The outer section 24B of each gore mesh, on the other hand, must be designed to sustain the overtravel of the outer ends of the reflector ribs at the conclusion of the deployment sequence without excessive stressing of the outer hoop wires, that is, without stressing of the outer hoop wires to a tension exceeding the preload tension of the outer hoop wires. In this connection, it will be recalled from the earlier description that stressing of the hoop wires beyond their preload tension causes permanent deformation or yielding of the hoop wires and resultant changing of the wire spring rate or stiffness. Preloading the hoop wires to a tension greater than the maximum tension they experience in actual use assures that the hoop wires spring rate or spring stiffness will remain unchanged, whereby the spring rate or stiffness of the reflector mesh in the space environment may be accurately predetermined and optimum antenna operation over the entire service life of the antenna may be assured.

According to this invention, the radially inner and outer wire mesh sections 24A, 24B of each reflector gore 24 are provided with spring rates or stiffness in the endwise directions of their hoop wires 26 which satisfy the above discussed critical conditions that the respective sections must withstand in use. That is, the inner section 24A is provided with a spring stiffness which accommodates the relative thermal expansion and contraction of the mesh and reflector dish 34 without the mesh becoming slack or exceeding the inner hoop wire preload. The outer section 24B is provided with a spring stiffness which accommodates overtravel of the outer ends of the reflector ribs without exceeding the outer hoop wires preload. As noted earlier, the spring rate or stiffness of the mesh may be varied by varying any one or more of several different hoop wire parameters. These parameters are wire spacing, wire diameter, wire metal, spring configuration or pitch, preload tension and initial or assembly tension.

A wire mesh antenna reflector according to the invention for use on an earth satellite has been constructed using a composite wire of about 0.002 inches in diameter formed from stainless steel and silver wire elements brazed to one another. Seven (7) of these composite wires were woven into a strand which was utilized as the hoop and radial wires. The reflector gores 24 of this reflector had radially inner and outer sections 24A, 24B (FIG. 2) with hoop wires having the general spring configuration of FIG. 4 and differing spring rates and preloads. Thus, the hoop wires in the radially inner section 24A of each gore had a 20-pitch spring configuration (hoop wire A in FIG. 4) and a 2-oz. preload and the hoop wires in the radially outer section 24B of each gore had a 32-pitch spring configuration (hoop wire B in FIG. 4) and a 4-oz. preload. The radial extent of the inner section 24A was approximately two-thirds the full radial extent of the reflector gore.

Figure 5:
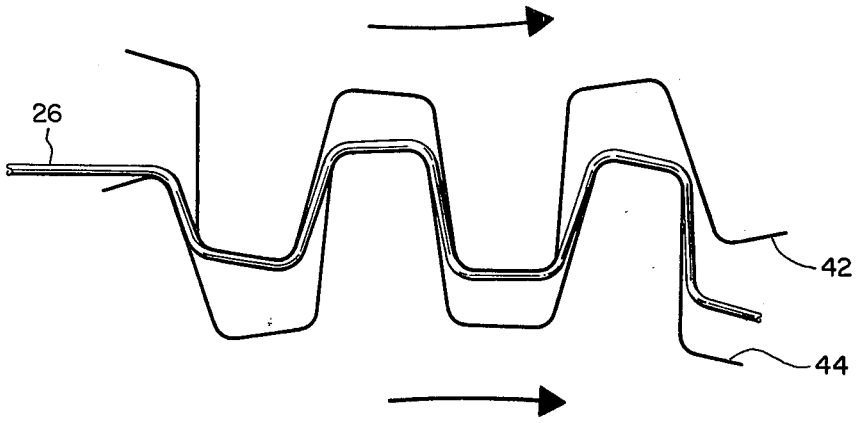
FIGS. 5 and 6 illustrate one method of forming the resiliently compliant spring wires of the mesh.
Figure 6:
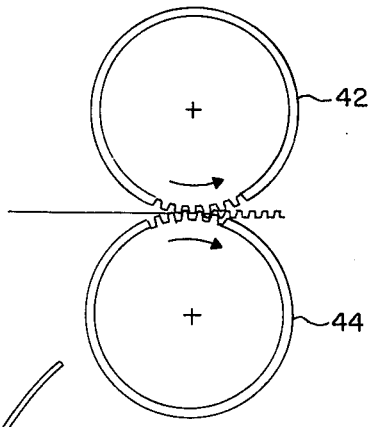

FIGS. 5 and 6 illustrate one method of forming the hoop wires 26 to their spring configuration. According to this method, wire strands are fed between two gears 42, 44 whose teeth are disposed in interfitting but not full meshing engagement. The radial overlap of the interfitting teeth in their positions of maximum overlap approximates the height of the spring arches. The corners of the teeth are rounded, as shown.

I claim:

1. A wire mesh structure comprising:

a supporting frame having spaced supporting members;

a wire mesh panel spanning the space between said supporting members including first wires extending between and secured to said supporting members and second wires disposed in crossing relation and secured to said first wires;

said first wires having a generally spring-like configuration which renders the latter wires resiliently compliant in their endwise directions, and said compliant wires being stressed in tension; and said panel having two sections whose wire mesh areas have differing spring rates in the endwise directions of their respective compliant wires.

2. A wire mesh structure according to claim 1 wherein: said structure comprises an antenna reflector.

3. A parabolic antenna reflector comprising:

a supporting frame having a central parabolic reflector dish, slender ribs uniformly spaced about and hinged at one end to said dish substantially flush with the front face thereof for swinging of said ribs forwardly and inwardly toward the axis of said dish to contracted stowage positions and rearwardly and outwardly from said stowage positions to deployed positions wherein said ribs extend generally radially out from said dish;

spring means for deploying said ribs from said stowage positions to said deployed positions;

said ribs and front dish face being parabolically curved to conform to a common parabolic surface curvature in the deployed positions of the ribs;

said ribs when deployed defining generally gore shaped spaces between adjacent ribs;

a wire mesh gore spanning each said gore shaped space including hoop wires extending between and terminally secured to the adjacent ribs and radial wires crossing and secured to said hoop wires;

said hoop wires having a generally spring-like configuration which renders the hoop wires resiliently compliant in their endwise direction, whereby each gore is resiliently compliant in the endwise direction of said hoop wires; and each gore having a radially inner section of relatively low spring rate and a radially outer section of relatively high spring rate in said endwise direction of their respective hoop wires.

* * * * *